US010805699B2

(12) United States Patent
Ivey

(10) Patent No.: US 10,805,699 B2
(45) Date of Patent: Oct. 13, 2020

(54) L-SHAPED STRATEGICALLY HIDDEN SPEAKER SYSTEM

(71) Applicant: Mitek Corp., Inc., Phoenix, AZ (US)

(72) Inventor: Johnathan Ivey, Chandler, AZ (US)

( * ) Notice: Subject to any disclaimer, the term of this patent is extended or adjusted under 35 U.S.C. 154(b) by 6 days.

(21) Appl. No.: 16/433,738

(22) Filed: Jun. 6, 2019

(65) Prior Publication Data

US 2019/0289377 A1 Sep. 19, 2019

Related U.S. Application Data

(63) Continuation-in-part of application No. 15/902,446, filed on Feb. 22, 2018, now Pat. No. 10,446,131.

(51) Int. Cl.

| | |
|---|---|
| ***H04R 1/02*** | (2006.01) |
| ***H04R 1/34*** | (2006.01) |
| ***H04R 3/00*** | (2006.01) |

(52) U.S. Cl.

CPC ..... *H04R 1/025* (2013.01); *H04R 1/026* (2013.01); *H04R 1/345* (2013.01); *H04R 3/00* (2013.01); *H04R 2201/021* (2013.01); *H04R 2420/09* (2013.01)

(58) Field of Classification Search

CPC ..... H04R 1/02

See application file for complete search history.

(56) References Cited

U.S. PATENT DOCUMENTS

| | | | | |
|---|---|---|---|---|
| 4,451,711 | A * | 5/1984 | Jackson | H04R 1/02 312/265.5 |
| 5,574,796 | A * | 11/1996 | Keezer | H04R 1/025 181/148 |
| 7,298,862 | B2 * | 11/2007 | Dedieu | H04M 1/03 381/182 |
| 8,315,417 | B2 * | 11/2012 | Basore | H04R 1/02 381/345 |
| 9,712,902 | B1 * | 7/2017 | Uziel | H04R 1/023 |
| 9,967,657 | B1 * | 5/2018 | Wang | H04R 1/025 |
| 2009/0010469 | A1 * | 1/2009 | Tracy | H04R 1/403 381/338 |
| 2010/0040254 | A1 * | 2/2010 | Wright | H04R 1/02 381/395 |
| 2011/0284315 | A1 * | 11/2011 | Litovsky | H04R 1/02 181/156 |
| 2014/0233778 | A1 * | 8/2014 | Hardiman | H04R 1/025 381/333 |

(Continued)

*Primary Examiner* — Olisa Anwah

(74) *Attorney, Agent, or Firm* — Keith L. Jenkins, Registered Patent Attorney LLC; Keith L. Jenkins

(57) ABSTRACT

A small, lightweight ceiling speaker assembly in a lightweight plastic tubular L-shaped housing with an inclined rear end closed by an electronics connection panel. The tubular L-shaped housing is assembled from right and left L-shaped halves and encloses a speaker, a multi-tap transformer, and control electronics. Selection of the transformer tap, zone selection, and configuration controls is accomplished manually on the electronics connection panel. Analog ANALOG IN and ANALOG OUT jacks are also located on the electronics connection panel. Spring-biased feet engage the top surface of a ceiling tile or panel to clamp the L-shaped strategically hidden speaker system against an annular flange of a releasably attachable sound diffuser or director.

20 Claims, 9 Drawing Sheets

(56) References Cited

U.S. PATENT DOCUMENTS

| | | | | |
|---|---|---|---|---|
| 2015/0036858 | A1* | 2/2015 | Aboabdo | H04R 1/02<br>381/334 |
| 2018/0184197 | A1* | 6/2018 | Kwolek | H04R 1/028 |
| 2019/0394562 | A1* | 12/2019 | Rumyantsev | H04R 1/30 |

* cited by examiner

1508

L-SHAPED STRATEGICALLY HIDDEN SPEAKER SYSTEM

RELATIONSHIP TO OTHER APPLICATIONS

This application is a CIP of U.S. patent application Ser. No. 15/902,446 filed 22 Feb. 2018 to the same inventor.

FIELD OF ART

The present invention relates to an L-shaped strategically hidden speaker. The present invention more particularly relates to a very small speaker housing for use with the strategically hidden speaker diffuser of U.S. patent Ser. No. 10/237,636 and the printable diffuser of U.S. patent application Ser. No. 15/902,446.

BACKGROUND OF THE INVENTION

Supporting downwardly directed loudspeakers above a ceiling tile or panel has attracted many approaches. For example, patent application Ser. No. 16/038,495 to the present inventor provides a novel support that rests on the grid members that support the ceiling tiles. Supporting the speaker directly on the ceiling tiles has historical produced deformation and failure of the ceiling tile. What is needed is a speaker and speaker enclosure that is light weight enough to be supported on the ceiling tile without deforming the tile.

SUMMARY OF THE INVENTION

The present invention provides a small lightweight ceiling speaker enclosure and ceiling speaker in an L-shaped tubular plastic housing that is compatible with applicant's sound diffusers and sound directors.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

Figure 1:
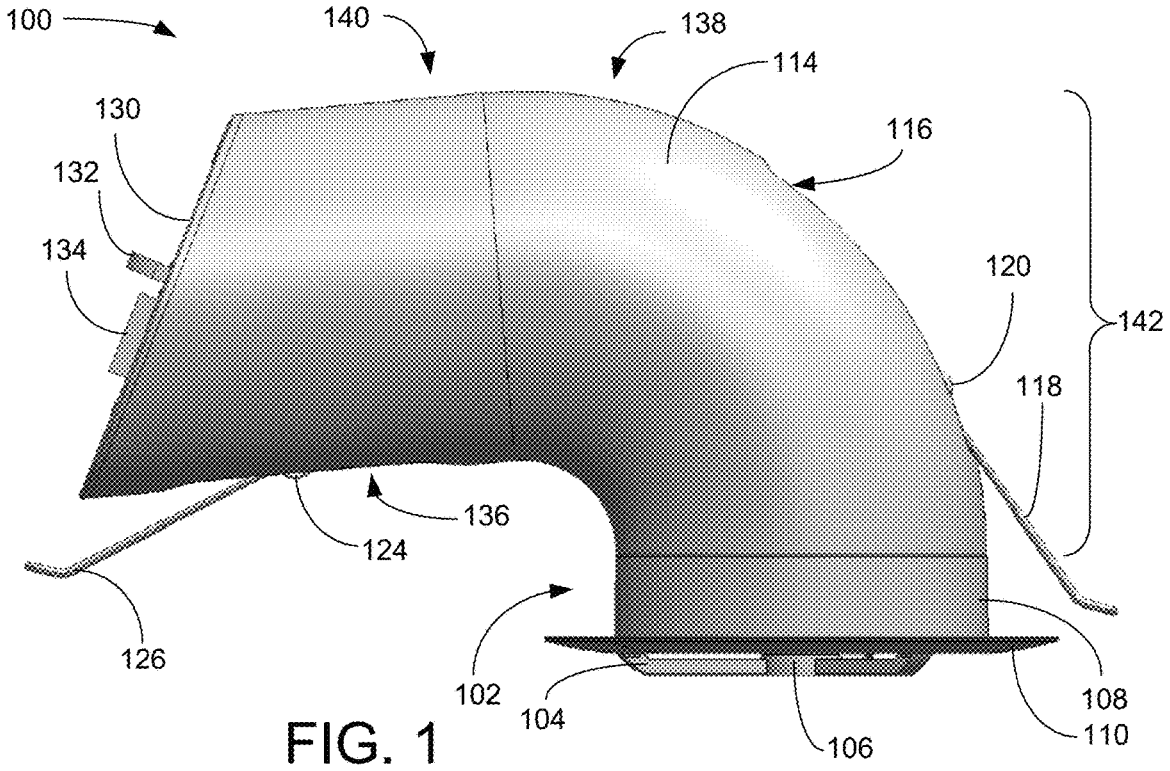
FIG. 1 is a side elevation shaded view illustrating an exemplary embodiment of an L-shaped strategically hidden speaker system, according to a preferred embodiment of the present invention.
Figure 8:
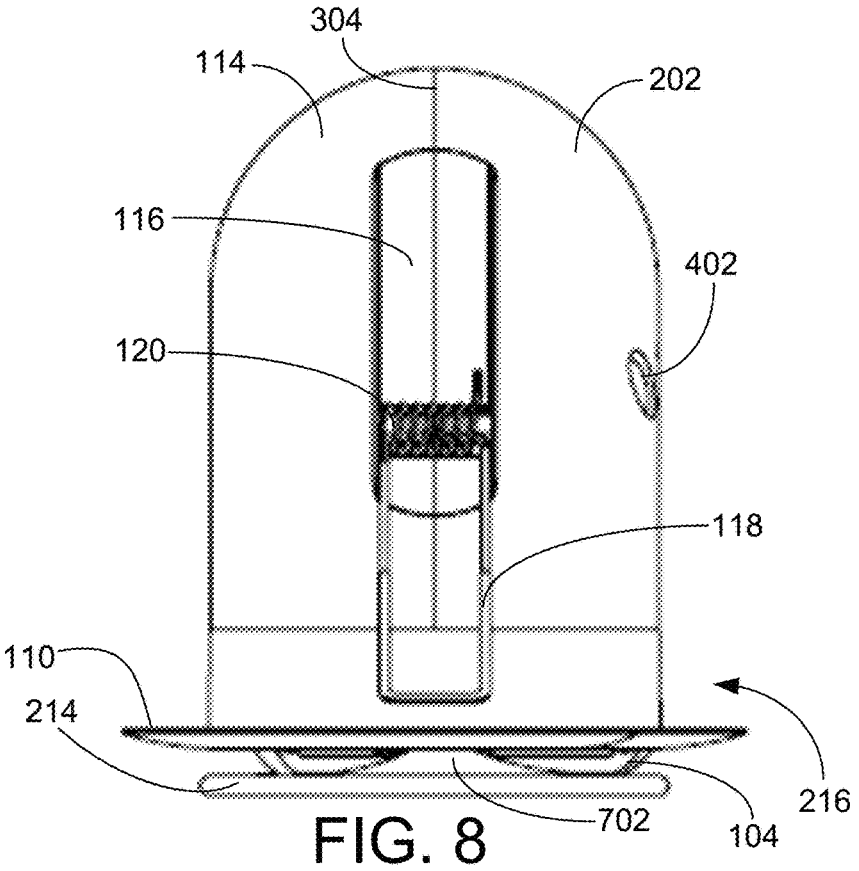
FIG. 8 is a front elevation view illustrating the exemplary embodiment of the L-shaped strategically hidden speaker system of FIG. 1, according to a preferred embodiment of the present invention.

As used and defined herein, words of relative position such as "rear", "front", "bottom", etc., are referenced to the operational orientation of the apparatus as shown in FIG. 1, in which the front is to the right side of FIG. 1 and the rear is to the left side of FIG. 1. As used and defined herein, words of relative position such as "left" and "right" are referenced to the operational orientation of the apparatus as shown in FIG. 8. As used and defined herein, the term "speaker" means "loudspeaker". The hundred(s) digits of reference numbers refer to the figure number in which the referenced item is first referenced. Arrows that do not touch on a drawing refer to portions of the apparatus. Arrows that touch a line in a drawing refer to the surface touched upon. Arrows the touch no line within a drawing refer to a surface within the drawing.

FIG. 1 is a left side elevation shaded view illustrating an exemplary embodiment of an L-shaped strategically hidden speaker system 100, according to a preferred embodiment of the present invention. L-shaped strategically hidden speaker system 100 includes a tubular L-shaped housing 142 and a sound diffuser support 102. Tubular L-shaped housing 142 includes a left L-shaped half 114 and a releasably connectable right L-shaped half 202 (see FIG. 2). Left L-shaped half 114 includes right-angle cylindrical half-tube portion 138 extending rearward as a straight declining cylindrical half-tube portion 140 having an inclined rear end to assist in supporting an electronics connection panel 130. Electronics connection panel 130 closes the rear end of tubular L-shaped housing 142 and includes a combined handle and wire guide 132 and configuration switch array 134. The front of the tubular L-shaped housing 142 supports a front coil spring 120 that biases front foot 118 to clamp the top surface of a ceiling tile 704 (see FIG. 7) when the L-shaped strategically hidden speaker system 100 is installed. For shipping and storage, front foot 118 may be stowed in front spring cavity 116. The bottom rear of the tubular L-shaped housing 142 supports a bottom rear coil spring 124 that biases rear foot 126 to clamp the top surface of a ceiling tile when the L-shaped strategically hidden speaker system 100 is installed. For shipping and storage, rear foot 126 may be stowed in bottom rear spring cavity 136. The tubular L-shaped housing 142 is illustrated as a circular cylindrical tube, but that is not a limitation of the present invention. For non-limiting examples, tubular L-shaped housing 142 may have any polygonal, other conic section, or irregular transverse cross section in respective various embodiments.

An adjustable sound diffuser coupling 102 is releasably and adjustably attachable to a bottom front portion of right-angle tube 138, which will be disclosed in more detail below. Sound diffuser coupling 102 includes diffuser barrel 108, annular flange 110 extending radially from a bottom edge of the diffuser barrel 108, and diffuser element supports 104 extending radially from hub 106 to diffuser barrel 108. A preferred sound diffuser coupling 102 is similar to the sound diffuser disclosed in U.S. Pat. No. 10,237,636 to the same inventor. In other embodiments, the sound director of U.S. patent application Ser. No. 16/129,175 to the same inventor may substitute for sound diffuser 216 (see FIG. 2). In other embodiments, the sound director and clean room cover of U.S. patent application Ser. No. 16/135,190 to the same inventor may substitute for sound diffuser 216 (see FIG. 2).

Figure 2:
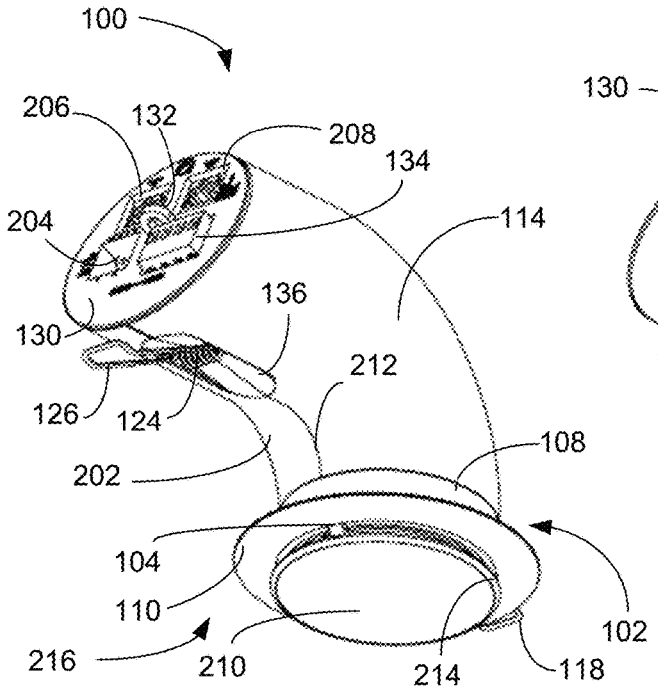
FIG. 2 is a rear-bottom perspective view illustrating the exemplary embodiment of the L-shaped strategically hidden speaker system of FIG. 1, according to a preferred embodiment of the present invention.

FIG. 2 is a rear-bottom perspective view illustrating the exemplary embodiment of the L-shaped strategically hidden speaker system 100 of FIG. 1, according to a preferred embodiment of the present invention. Electronics connection panel 130 supports an ANALOG IN jack 206, an ANALOG OUT jack 208, and a combination TAP SETTING and ZONE SELECT switch panel 204, in addition to the combined handle and wire guide 132 and configuration switch array 134 mentioned above. The tubular L-shaped housing 142 is preferably made of a left L-shaped half 114 and a right L-shaped half 202 mated along bottom seam 212 and top seam 302 (see FIG. 3). Left L-shaped half 114 includes a left half of the right-angle cylindrical tube portion 138 and a left half of straight cylindrical tube portion 140. Left and right L-shaped halves 114 and 202 are preferably releasably connectable L-shaped halves 114 and 202. Diffuser element 214 and cover plate 210 are shown added to sound diffuser coupling 102 to form sound diffuser 216. An improved view of bottom rear spring cavity 136, bottom rear coil spring 124, and rear foot 126 is provided. Preferably, rear foot 126 and bottom rear coil spring 124 are of one piece. In some embodiments, sound diffuser 216 may be a printable sound diffuser 216 as disclosed in U.S. patent application Ser. No. 15/902,446 to the same inventor.

Figure 3:
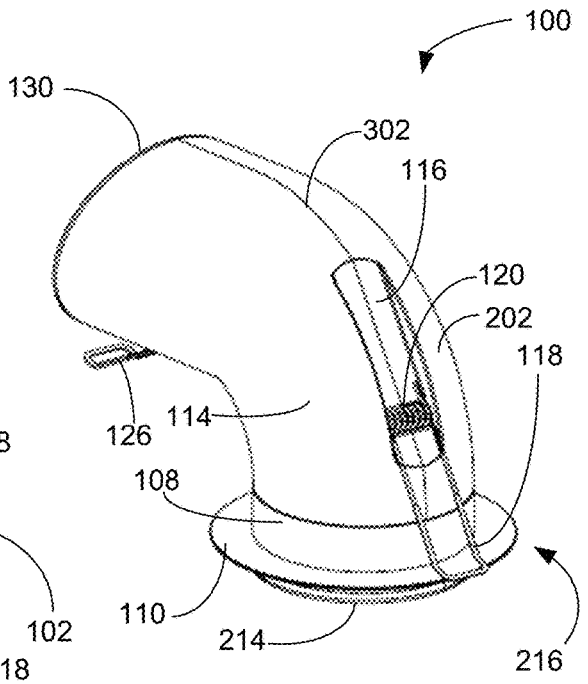
FIG. 3 is a front-top perspective view illustrating the exemplary embodiment of the L-shaped strategically hidden speaker system of FIG. 1, according to a preferred embodiment of the present invention.

FIG. 3 is a front-top perspective view illustrating the exemplary embodiment of the L-shaped strategically hidden speaker system 100 of FIG. 1, according to a preferred embodiment of the present invention. Top seam 302 extends the entire length of the L-shaped strategically hidden speaker housing 142. An improved view of front spring cavity 116, front coil spring 120, and front foot 118 is provided. Preferably, front foot 118 and front coil spring 120 are of one piece.

Figure 4:
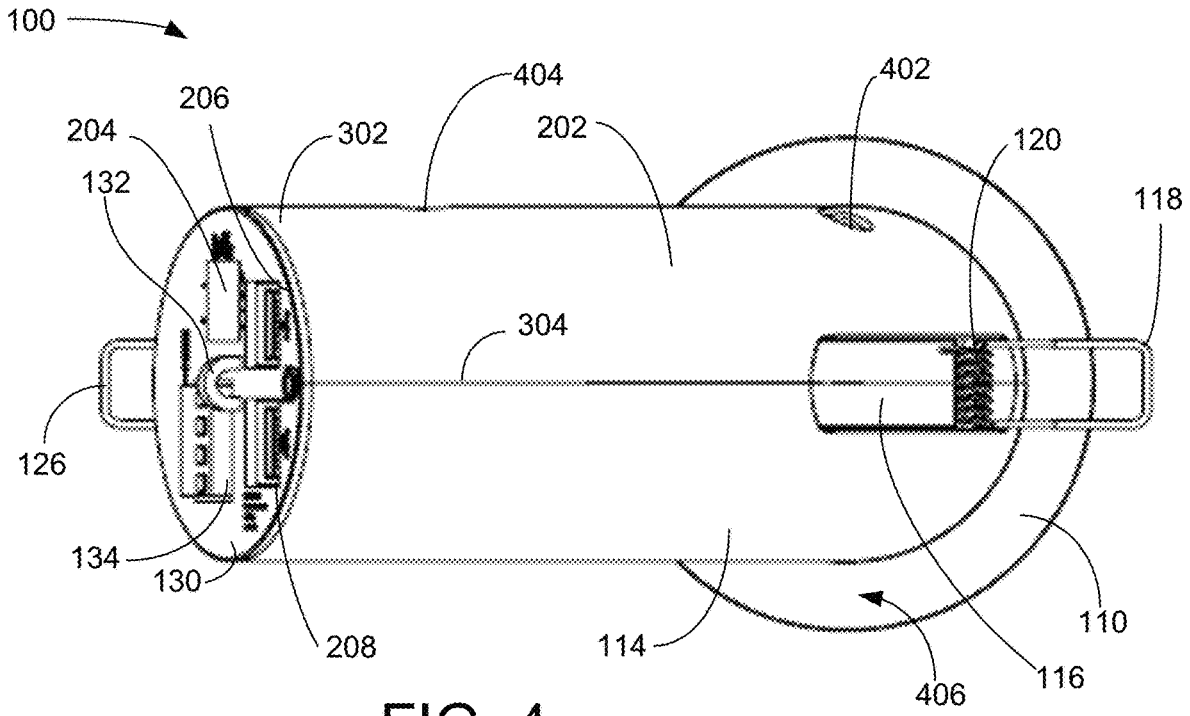
FIG. 4 is top plan view illustrating the exemplary embodiment of the L-shaped strategically hidden speaker system of FIG. 1, according to a preferred embodiment of the present invention.

FIG. 4 is top plan view illustrating the exemplary embodiment of the L-shaped strategically hidden speaker system 100 of FIG. 1, according to a preferred embodiment of the present invention. Exterior fastener channel openings 402 and 404 can be seen on right L-shaped half 202 of the L-shaped strategically hidden speaker housing 142. When installed, a top surface 406 of annular flange 110 engages an under side of a ceiling tile 704 (see FIG. 7) or the like, and front and bottom rear feet 118 and 126 engage the top surface of that ceiling tile 704, thereby clamping the L-shaped strategically hidden speaker system 100 to the ceiling tile 704.

Figure 5:
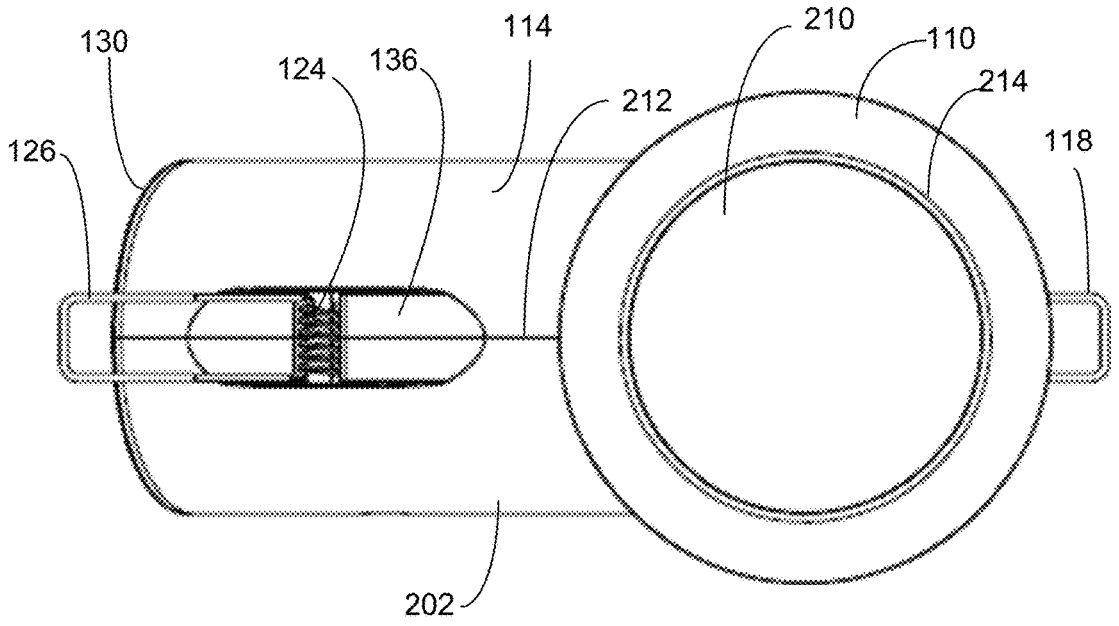
FIG. 5 is a bottom plan view illustrating the exemplary embodiment of the L-shaped strategically hidden speaker system of FIG. 1, according to a preferred embodiment of the present invention.

FIG. 5 is a bottom plan view illustrating the exemplary embodiment of the L-shaped strategically hidden speaker system 100 of FIG. 1, according to a preferred embodiment of the present invention. Annular flange 110, diffuser element 214, and cover plate 210 are visible below the ceiling tile 704 (see FIG. 7) when the L-shaped strategically hidden speaker system 100 is installed. The remainder of the L-shaped strategically hidden speaker system 100 is within or above the ceiling tile 704.

Figure 6:
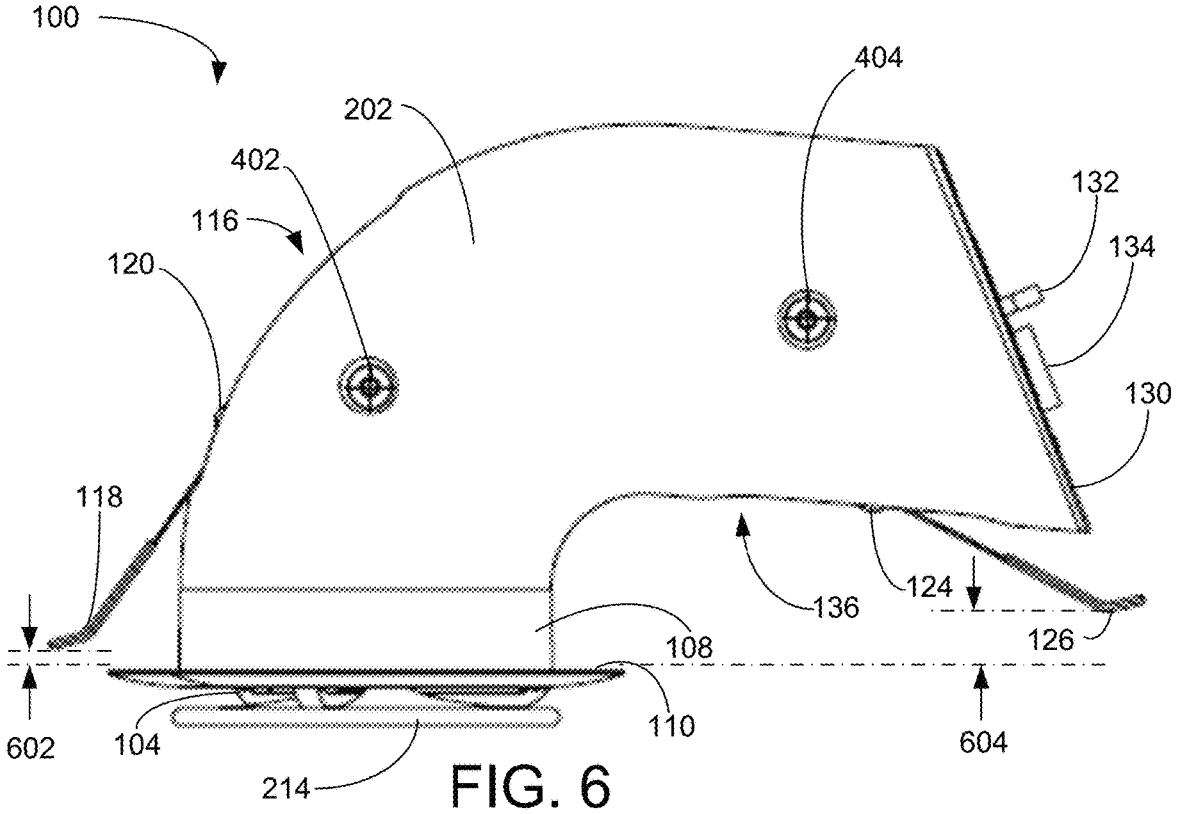
FIG. 6 is a left side elevation view illustrating the L-shaped strategically hidden speaker system of FIG. 1, according to a preferred embodiment of the present invention.

FIG. 6 is a left side elevation view illustrating the exemplary embodiment of the L-shaped strategically hidden speaker system 100 of FIG. 1, according to a preferred embodiment of the present invention. Exterior fastener channel openings 402 and 404 can be seen more clearly on the right L-shaped half 202 of the L-shaped strategically hidden speaker. The position of rear foot 126 is suggestive of an upper limit of travel for rear foot 126 and for front foot 118. The range of thicknesses of mountable ceiling tiles 704 (see FIG. 7) is suggested by the difference in height between a front foot 118 minimum 602 and a rear foot 126 maximum 604. In various embodiments, respective various thickness ranges may supported.

Figure 7:
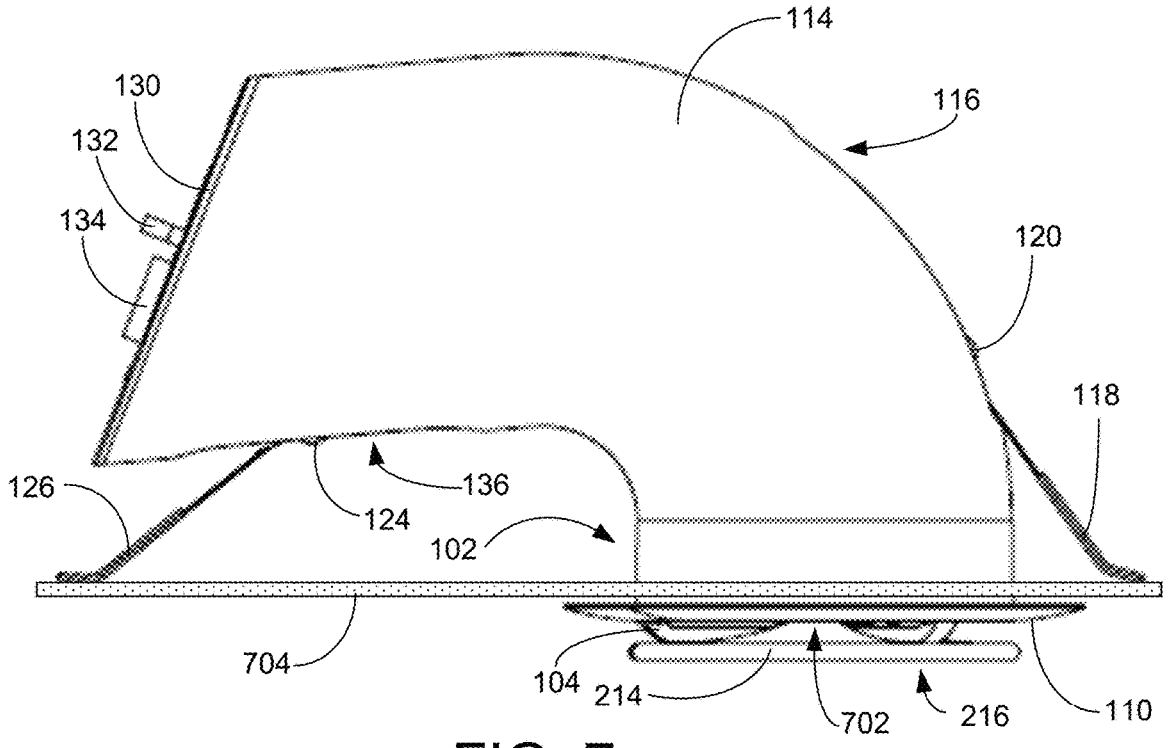
FIG. 7 is a right side elevation view illustrating the exemplary embodiment of the L-shaped strategically hidden speaker system of FIG. 1, according to a preferred embodiment of the present invention.

FIG. 7 is a right side elevation view illustrating the exemplary embodiment of the L-shaped strategically hidden speaker system 100 of FIG. 1, according to a preferred embodiment of the present invention. Diffuser element 214 has an arcuate diffuser surface 702. The L-shaped strategically hidden speaker system 100 is shown mounted on a thin portion of a ceiling tile 704. The small size and light weight of the L-shaped strategically hidden speaker system 100 has the advantages of being mountable on thin (weak) ceiling tiles 704, being cheaper to make, and being cheaper to ship due to both volume and weight considerations. Additionally, it is advantageous that the L-shaped strategically hidden speaker system 100 needs little headroom above the ceiling tile. It is also advantageous that the L-shaped strategically hidden speaker system 100 can be installed without reopening the ceiling (see FIGS. 15A-15I)

FIG. 8 is a front elevation view illustrating the exemplary embodiment of the L-shaped strategically hidden speaker system 100 of FIG. 1, according to a preferred embodiment of the present invention. The left L-shaped half 114 and the right L-shaped half 202 both contain portions of front spring cavity 116.

Figure 9:
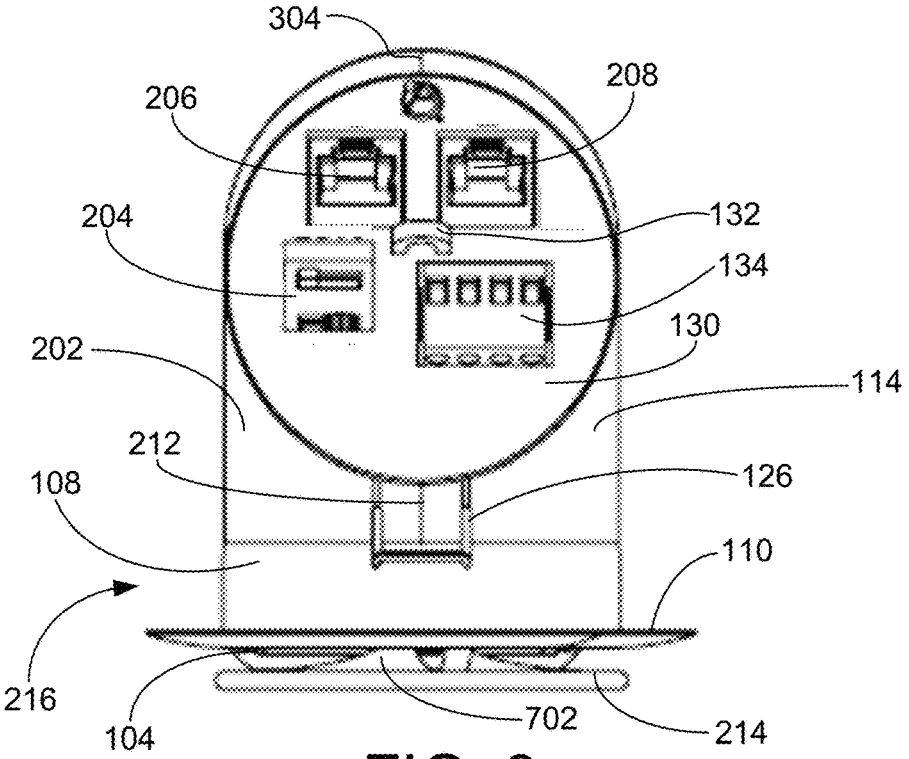
FIG. 9 is a rear elevation view illustrating the exemplary embodiment of the L-shaped strategically hidden speaker system of FIG. 1, according to a preferred embodiment of the present invention.

FIG. 9 is a rear elevation view illustrating the exemplary embodiment of the L-shaped strategically hidden speaker system 100 of FIG. 1, according to a preferred embodiment of the present invention. For greater detail, see FIG. 13.

Figure 10:
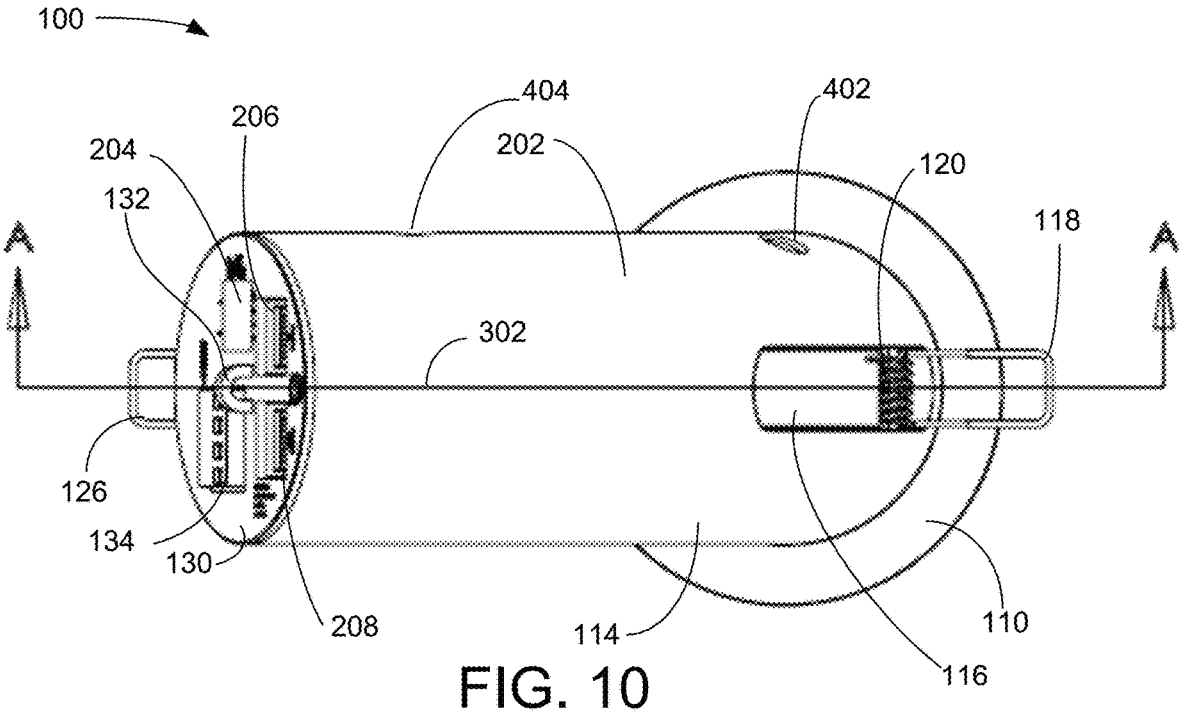
FIG. 10 is a top plan view illustrating the exemplary embodiment of the L-shaped strategically hidden speaker system of FIG. 1 and defining cross section AA, according to a preferred embodiment of the present invention.

FIG. 10 is a top plan view illustrating the exemplary embodiment of the L-shaped strategically hidden speaker system 100 of FIG. 1 and defining cross section AA, according to a preferred embodiment of the present invention Cross section AA is coextensive with top seam 302 and bottom seam 212. In a particular embodiment, housing 142 may have one or more vents for dissipating heat from the transformer 1110 and speaker assembly 1120.

Figure 11:
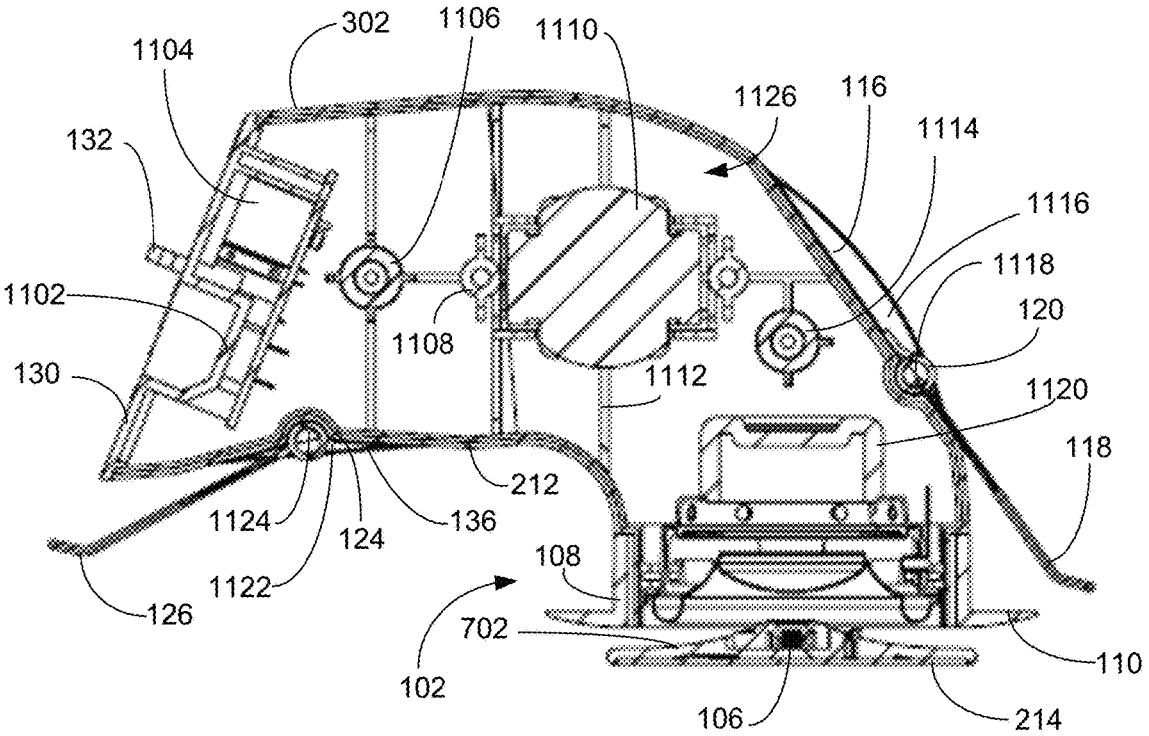
FIG. 11 is a side cross-sectional view through cross section AA illustrating the exemplary embodiment of the L-shaped strategically hidden speaker system of FIG. 1, according to a preferred embodiment of the present invention.

FIG. 11 is a side cross-sectional view through cross section AA illustrating the exemplary embodiment of the L-shaped strategically hidden speaker system 100 of FIG. 1, according to a preferred embodiment of the present invention. Electronics connection panel 130 includes forward-mounted electronics chassis 1102 and electronics package 1104. Internal fastener channel 1106 is an interior extension from external fastener channel opening 404 and internal fastener channel extension 1114 is an interior extension from external fastener channel opening 402, which are used to assist in connecting right L-shaped half 202 to left L-shaped half 114 via an elongated releasable fastener. Additional interior fastener channels (not shown) extend inwardly from the interior surface of left L-shaped half and are aligned with internal fastener channel extensions 1106 and 1114 during assembly. An elongated releasable fastener (not shown) extends through external fastener channel opening 402, through internal fastener channel extension 1114, and into the additional aligned fastener channels extending from the interior surface of the left L-shaped half to connect left and right L-shaped halves 114 and 202 together. Another elongated releasable fastener (not shown) extends through external fastener channel opening 404, through internal fastener channel 1106, and into the additional aligned fastener channels extending from the interior surface of the left L-shaped half to connect left and right L-shaped halves together. Transformer fastener channels 1108 (one of two labeled) extend from interior surface 1126 of right L-shaped half 202 to assist in fastening multi-tap transformer 1110 to right L-shaped half 202 via elongated releasable fasteners, such as screws and the like. Ribs 1112 (one of four labeled) provide structural strength for the right L-shaped half 202. Additional ribs, not shown, strengthen the left L-shaped half 114. Internal fastener channel extension 1114 from external fastener channel opening 404 is used to assist in connecting right L-shaped half 202 to left L-shaped half 114 via an elongated releasable fastener. Right front half-axle 1118 extends from a right sidewall 1116 of front spring cavity 116. Left front half-axle 1226 (see FIG. 12) extends from a left sidewall (not shown, but corresponds to right sidewall 1116) of front spring cavity 116. Front coil spring 120 is mounted on right front half-axle 1118 and left front half-axle 1226 (see FIG. 12), which are aligned and abutted to form a single front axle during assembly. Bottom rear right half-axle 1124 extends from a right sidewall 1122 of bottom rear spring cavity 136. Bottom rear left half axle (not shown, but similar to bottom rear right half-axle 1124) extends from a left sidewall (not shown, but similar to right sidewall 1122) of bottom rear spring cavity 136. Bottom rear coil spring 124 is mounted on bottom left half axle and bottom rear right half-axle 1124, which are aligned and abutted to form a single rear axle during assembly.

Speaker assembly 1120 includes a midrange speaker and a tweeter. In other embodiments, respective other types of speakers may be used. For non-limiting examples, woofers, voice masking speakers, mid-range only, and tweeters only, may be used in respective other embodiments.

Figure 12:
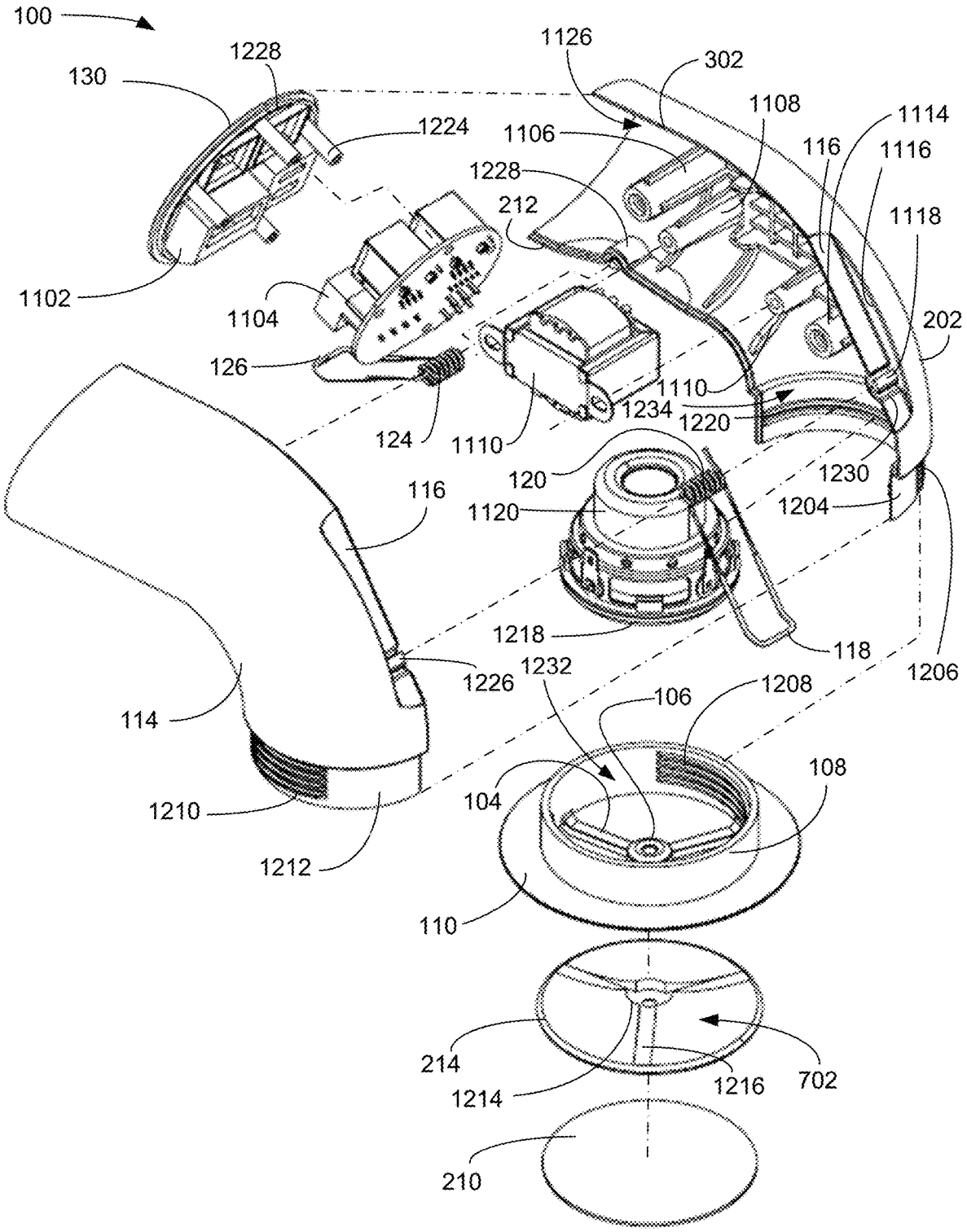
FIG. 12 is a top front exploded view illustrating the exemplary embodiment of the L-shaped strategically hidden speaker system of FIG. 1, according to a preferred embodiment of the present invention.

FIG. 12 is a top front exploded view illustrating the exemplary embodiment of the L-shaped strategically hidden speaker system 100 of FIG. 1, according to a preferred embodiment of the present invention. Electronics chassis 1102 extends from the interior surface 1226 of electronics connection panel 130 and includes four fastener channels 1224 (one of four labeled) for assisting in mounting electronics package 1104 to the electronics chassis 1102.

Right L-shaped half 202 of the L-shaped strategically hidden speaker tubular L-shaped housing 142 has a right semi-cylindrical half 1204 of a cylindrical acoustic channel shell 1402 (see FIG. 14) having a first set of partial threads 1206 on an exterior surface thereof, as shown. The interior surface 1234 of acoustic channel shell right semi-cylindrical half 1204 has a central circumferential groove 1220 to assist in receiving and retaining the basket rim 1218 of speaker assembly 1120. Left L-shaped half 114 of the L-shaped strategically hidden speaker tubular L-shaped housing 142 has a left semi-cylindrical half 1212 of acoustic channel shell 1402 (see FIG. 14) having a second set of partial external threads 1210 on an exterior surface thereof, as shown. First and second sets of partial external threads 1206 and 1210 are spaced apart circumferentially and opposing on the acoustic channel shell 1402, when assembled. The interior surface (not visible in this view) of acoustic channel shell left semi-cylindrical half 1212 has a central circumferential groove (not shown, but corresponding to right central circumferential groove 1220) to receive and retain the basket rim 1218 of speaker assembly 1120. The first and second sets of partial external threads 1206 and 1210, respectively, are opposed and each extends circumferentially over less than ninety angular degrees. Diffuser barrel 108 has two opposed spaced-apart sets of partial threads 1208 (one visible in this view) that correspond to partial external threads 1206 and 1210. Diffuser barrel 108 has an interior surface 1232 that supports partial internal threads 1208. In installation, diffuser barrel 108 is aligned to assembled acoustic channel shell 1402 (see FIG. 14) such that the threads 1206 do not engage with partial internal threads 1208 and diffuser barrel 108 slides upward smoothly until the top surface 406 of annular flange 110 contacts the underside of a ceiling tile 704. The diffuser barrel 108 is then rotated to engage the partial external threads 1206 with partial internal threads 1208 (and partial external threads 1210 with a corresponding opposing set of partial threads in diffuser barrel 108) to tighten the sound diffuser 216 in place. Diffuser element 214 has a central cavity 1214 for receiving and retaining hub 106 and has channels 1216 (one of three labeled) for receiving diffuser element supports 104 (one of three labeled).

Front spring cavity 116 has a flat floor that includes a transverse concave portion 1230 half surrounding the right front half-axle 1118. Bottom rear spring cavity 136 has a flat floor that includes a transverse concave portion 1228 half surrounding the bottom rear half-axle 1124.

Figure 13:
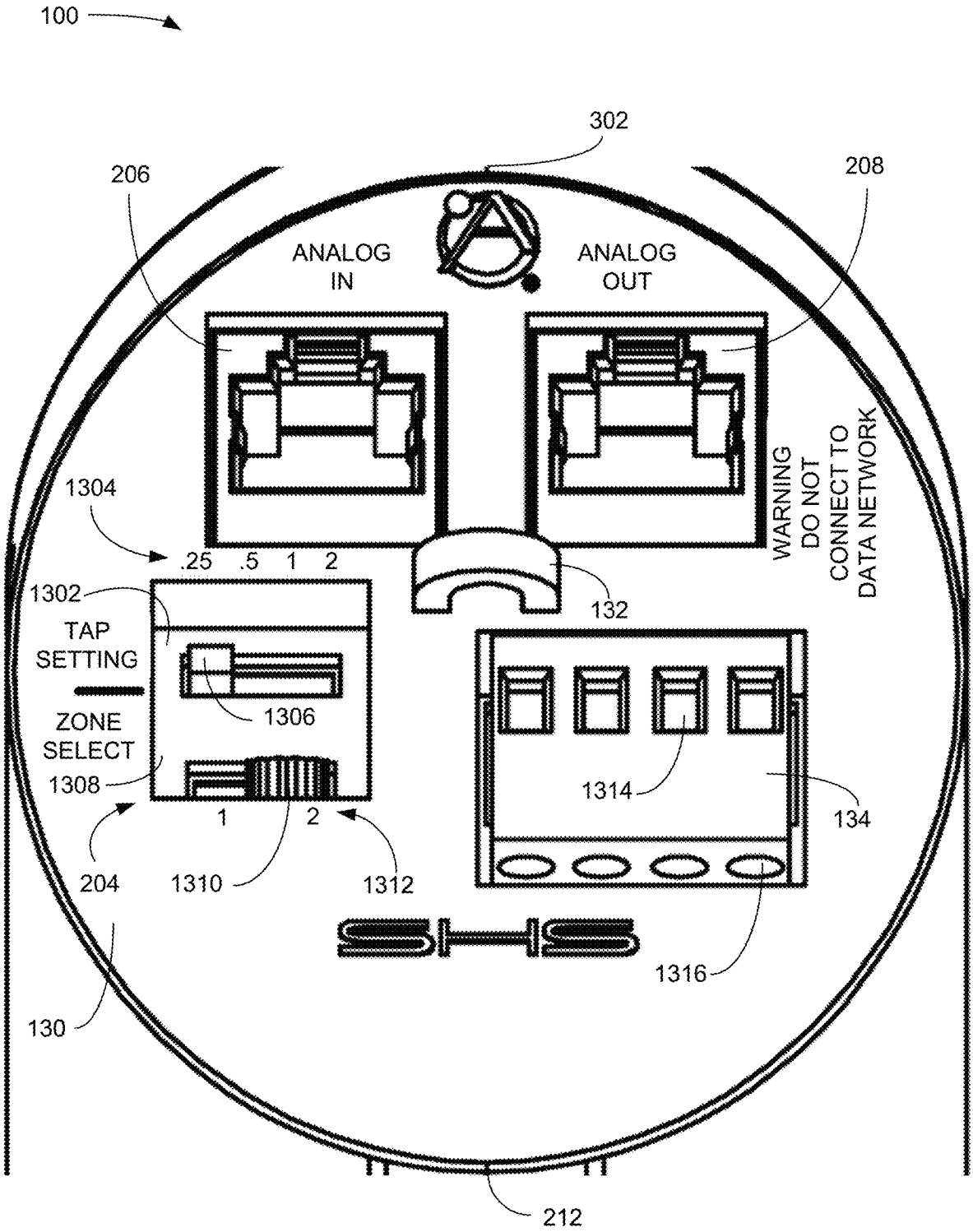
FIG. 13 is a detailed rear elevation view illustrating the exemplary embodiment of the L-shaped strategically hidden speaker system of FIG. 1, according to a preferred embodiment of the present invention.

FIG. 13 is a detailed rear elevation view illustrating the exemplary embodiment of the L-shaped strategically hidden speaker system 100 of FIG. 1, according to a preferred embodiment of the present invention. Switch panel 204 includes a tap setting 1302 for the multi-tap transformer 1110. Slider 1306 can be manually positioned to align to the desired tap setting 1304. Zone select switch also uses a slider 1310 to align to the desired zone 1312. Configuration switch array 134 has four configuration switches 1314 (one of four labeled) and four corresponding LED indicator lights 1316 (one of four labeled) to indicate the state of the switches 1314. The illustrated number of tap settings 1304, zone settings 1312, configuration switches 1314, and LED indicator lights 1316 are not meant to limit the invention. In various embodiments, respective various numbers of tap settings 1304, zone settings 1312, configuration switches 1314, and LED indicator lights 1316 may be used. Likewise, in various embodiments, respective various arrangements of ANALOG IN coupling 206, ANALOG OUT coupling 208, switch panel 204, combined handle and wire guide 132 and configuration switch array 134 may be used.

Figure 14:
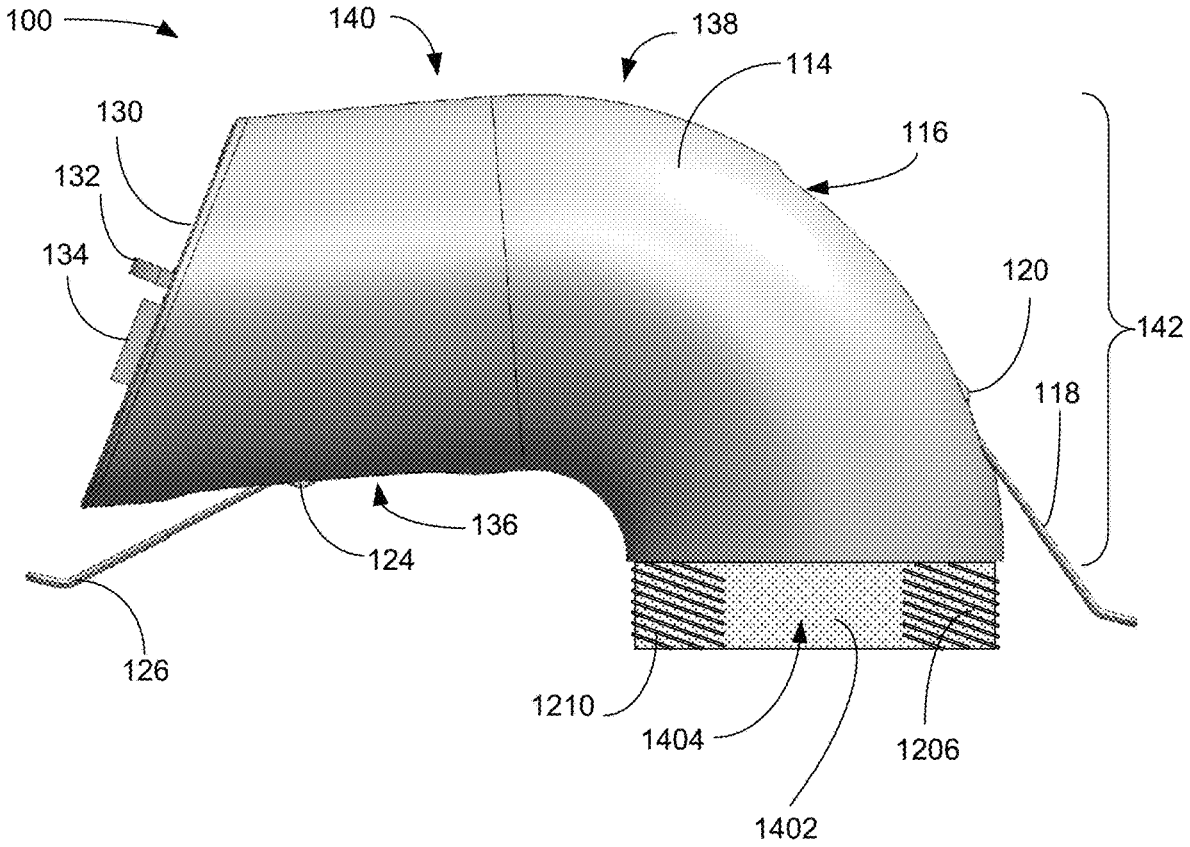
FIG. 14 is a side elevation shaded view illustrating the exemplary embodiment of the L-shaped strategically hidden speaker system of FIG. 1, according to a preferred embodiment of the present invention.

FIG. 14 is a side elevation shaded view illustrating an exemplary embodiment of an L-shaped strategically hidden speaker system 100, according to a preferred embodiment of the present invention. FIG. 14 is FIG. 1 with the diffuser support 102 removed to show the acoustic channel shell 1402, which is assembled by joining L-shaped left half 114 with L-shaped right half 202 to connect left semi-cylindrical half 1212 to right semi-cylindrical half 1204. Left semi-cylindrical half 1212 of acoustic channel shell 1402 is preferably of one piece with L-shaped left half 114. Right semi-cylindrical half 1204 of acoustic channel shell 1402 is preferably of one piece with L-shaped right half 202. First and second sets of partial threads 1206 and 1210 extend for the exterior surface 1404 of the acoustic channel shell 1402.

Figure 15A:
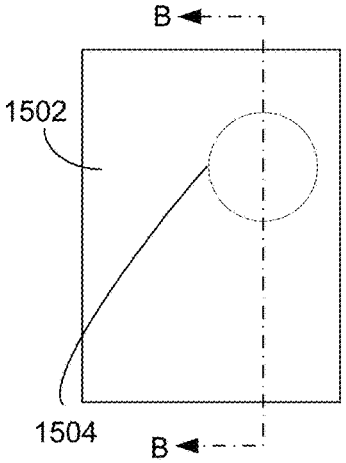
FIG. 15A is a bottom plan view illustrating An exemplary ceiling tile with an exemplary hole in it for receiving an exemplary embodiment of the L-shaped strategically hidden speaker system of FIG. 1 and defining cross section BB, according to a preferred embodiment of the present invention.

FIG. 15A is a bottom plan view illustrating an exemplary ceiling tile 1502 with an exemplary hole 1504 in it for receiving an exemplary embodiment of the L-shaped strategically hidden speaker system 100 of FIG. 1 and defining cross section BB, according to a preferred embodiment of the present invention. Ceiling tile 1502 is thicker than ceiling tile 704. Hole 1504 is sized corresponding to the size of housing 142. FIG. 15A through FIG. 15G illustrate the steps of installing the L-shaped strategically hidden speaker system 100. The ability to install the L-shaped strategically hidden speaker system 100 without reopening the ceiling is an advantage of the present invention. FIG. 15A illustrates a first step in installing the L-shaped strategically hidden speaker system 100.

Figure 15B:
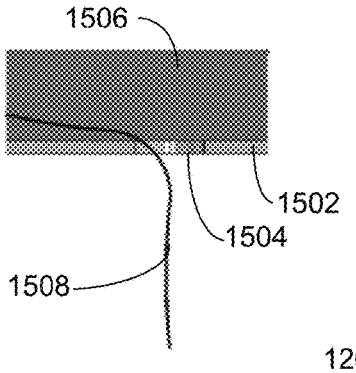
FIG. 15B is a side elevation cross-sectional view through cross section BB illustrating a ceiling tile with a hole in it for receiving an exemplary embodiment of an L-shaped strategically hidden speaker system of FIG. 1, according to a preferred embodiment of the present invention.

FIG. 15B is a side elevation cross-sectional view through cross section BB illustrating the exemplary ceiling tile 1502 with the exemplary hole 1504 in it for receiving an exemplary embodiment of an L-shaped strategically hidden speaker system 100 of FIG. 1, according to a preferred embodiment of the present invention. Electrical loudspeaker wiring 1508 extends through hole 1504 in installed ceiling tile 1502. A wall 1506 may be in proximity to the hole 1504. FIG. 15B illustrates a second step in installing the L-shaped strategically hidden speaker system 100.

Figure 15C:
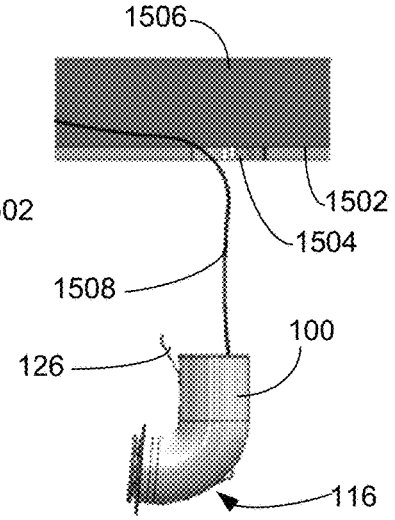
FIG. 15C is a side elevation cross-sectional view through cross section BB illustrating a ceiling tile with a hole in it for receiving an exemplary embodiment of the L-shaped strategically hidden speaker system of FIG. 1, according to a preferred embodiment of the present invention.

FIG. 15C is a side elevation cross-sectional view through cross section BB illustrating the exemplary ceiling tile 1502 with the exemplary hole 1504 in it for receiving an exemplary embodiment of the L-shaped strategically hidden speaker system 100 of FIG. 1, according to a preferred embodiment of the present invention. Electrical connection of electrical loudspeaker wiring 1508 to the L-shaped strategically hidden speaker system 100 takes place below the installed ceiling tile 1502, avoiding opening up the ceiling to access the electrical connection panel 130. The L-shaped strategically hidden speaker system 100 is illustrated without combined handle and wire guide 132 for simplicity of the drawing. FIG. 15C illustrates a third step in installing the L-shaped strategically hidden speaker system 100.

Figure 15D:
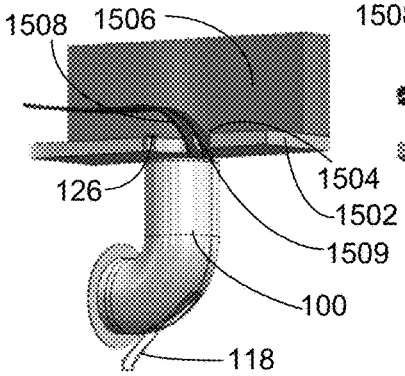
FIG. 15D is a side perspective cross-sectional view through cross section BB illustrating a ceiling tile with a hole in it for receiving an exemplary embodiment of the L-shaped strategically hidden speaker system of FIG. 1, according to a preferred embodiment of the present invention.

FIG. 15D is a side perspective cross-sectional view through cross section BB illustrating the exemplary ceiling tile 1502 with the exemplary hole 1504 in it for receiving an exemplary embodiment of the L-shaped strategically hidden speaker system 100 of FIG. 1, according to a preferred embodiment of the present invention. electrical loudspeaker wiring ANALOG IN wire 1509 and ANALOG OUT wire 1508 can been seen separately in this view. Rear foot 126 is pressed rearward and enters hole 1504 first as the L-shaped strategically hidden speaker system 100 is inserted into hole 1504. FIG. 15D illustrates a fourth step in installing the L-shaped strategically hidden speaker system 100.

Figure 15E:
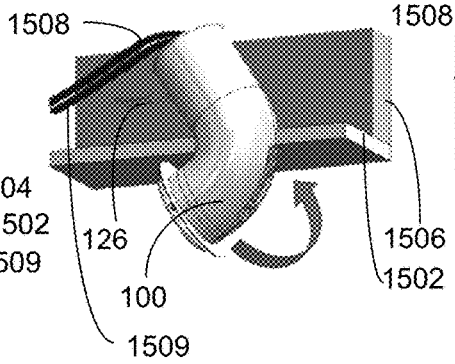
FIG. 15E is a side perspective cross-sectional view through cross section BB illustrating a ceiling tile with a hole in it for receiving an exemplary embodiment of the L-shaped strategically hidden speaker system of FIG. 1, according to a preferred embodiment of the present invention.

FIG. 15E is a side perspective cross-sectional view through cross section BB illustrating the exemplary ceiling tile 1502 with the exemplary hole 1504 in it for receiving an exemplary embodiment of the L-shaped strategically hidden speaker system 100 of FIG. 1, according to a preferred embodiment of the present invention. The right-angle cylindrical tube portion 138 is pushed through hole 1504 and rear foot 126 deploys. Front foot 118 is pressed rearward in preparation for insertion into hole 1504. FIG. 15E illustrates a fifth step in installing the L-shaped strategically hidden speaker system 100.

Figure 15F:
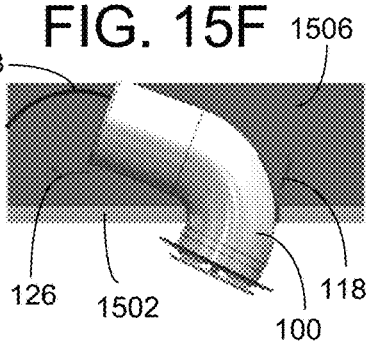
FIG. 15F is a side elevation cross-sectional view through cross section BB illustrating a ceiling tile with a hole in it for receiving an exemplary embodiment of the L-shaped strategically hidden speaker system of FIG. 1, according to a preferred embodiment of the present invention.

FIG. 15F is a side elevation cross-sectional view through cross section BB illustrating the exemplary ceiling tile 1502 with the exemplary hole 1504 in it for receiving an exemplary embodiment of the L-shaped strategically hidden speaker system 100 of FIG. 1, according to a preferred embodiment of the present invention. Front foot 118 and rear foot 126 begin to deploy as the L-shaped strategically hidden speaker system 100 is inserted further into hole 1504. FIG. 15F illustrates a sixth step in installing the L-shaped strategically hidden speaker system 100.

Figure 15G:
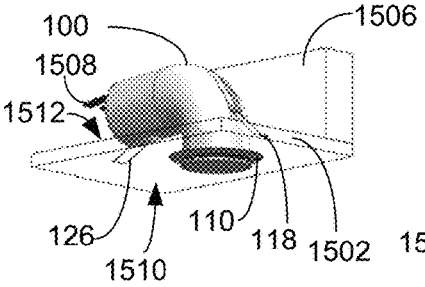
FIG. 15G is a bottom perspective cross-sectional view through cross section BB illustrating a ceiling tile with a hole in it for receiving an exemplary embodiment of an L-shaped strategically hidden speaker system of FIG. 1, according to a preferred embodiment of the present invention.

FIG. 15G is a bottom perspective cross-sectional view through cross section BB illustrating the exemplary ceiling tile 1502 with the exemplary hole 1504 in it for receiving an exemplary embodiment of an L-shaped strategically hidden speaker system 100 of FIG. 1, according to a preferred embodiment of the present invention. The L-shaped strategically hidden speaker system 100 is fully inserted into hole 1504 and rear foot 126 and front foot 118 are fully deployed to contact a top surface 1512 of ceiling tile 1502 to clamp the top surface 406 of annular flange 110 to the bottom surface 1510 of ceiling tile 1502. FIG. 15G illustrates a final step in installing the L-shaped strategically hidden speaker system 100.

Figure 15H:
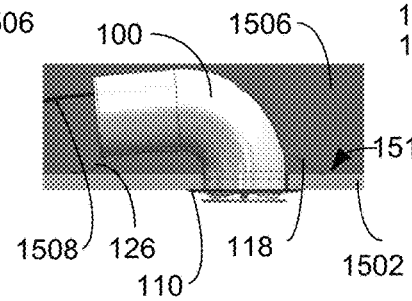
FIG. 15H is a side elevation cross-sectional view through cross section BB view illustrating a ceiling tile with a hole in it for receiving an exemplary embodiment of an L-shaped strategically hidden speaker system of FIG. 1, according to a preferred embodiment of the present invention.

FIG. 15H is a side elevation cross-sectional view through cross section BB view illustrating the exemplary ceiling tile 1502 with the exemplary hole 1504 in it for receiving an exemplary embodiment of an L-shaped strategically hidden speaker system 100 of FIG. 1, according to a preferred embodiment of the present invention. The contact of rear foot 126 and front foot 118 with the top surface 1512 of ceiling tile 1502 can be clearly seen.

Figure 15I:
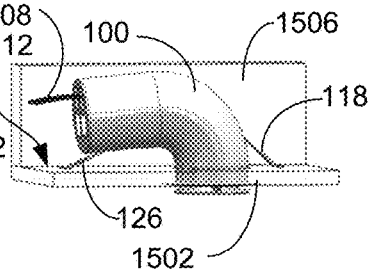
FIG. 15I is a rear perspective cross-sectional view through cross section BB illustrating a ceiling tile with a hole in it for receiving an exemplary embodiment of the L-shaped strategically hidden speaker system of FIG. 1, according to a preferred embodiment of the present invention.

FIG. 15I is a top rear perspective cross-sectional view through cross section BB illustrating the exemplary ceiling tile 1502 with the exemplary hole 1504 in it for receiving an exemplary embodiment of the L-shaped strategically hidden speaker system 100 of FIG. 1, according to a preferred embodiment of the present invention. FIG. 15I provides a better view of the top surface 1512 of ceiling tile 1502.

The claim below include functional claims. No statements of intended use are contained in the claims.

I claim:

1. An L-shaped strategically hidden speaker system comprising:

a. a tubular L-shaped housing comprising:
   i. right and left releasably connectable L-shaped housing halves;
   ii. right and left semi-cylindrical sides of an acoustic channel cylindrical shell, each extending downwardly from respective right and left front ends of respective said right and left releasably connectable L-shaped housing halves; and
   iii. first and second circumferentially spaced-apart and opposed sets of partial threads on respective first and second exterior surfaces of respective said right and left sides of said acoustic channel cylindrical shell; and b. a downwardly-directed speaker assembly in said front end of said housing, when said speaker system is assembled;

c. an electronic connection panel closing an inclined rear end of said housing, when said speaker system is assembled.

2. The speaker system of claim 1, comprising:

a. a first plurality of exterior fastener channel openings in said right releasably connectable L-shaped half; and b. a first corresponding plurality of interior fastener channel extensions extending inwardly from respective said first plurality of exterior fastener channel openings in said right releasably connectable L-shaped half.

3. The speaker system of claim 1, comprising a second corresponding plurality of interior fastener channels extending from an interior surface of said left releasably connectable L-shaped half, wherein said second corresponding plurality of interior fastener channels are alignable to respective said first corresponding plurality of interior fastener channel extensions.

4. The speaker system of claim 3, comprising:

a. first and second interior fastener channels extending inwardly from an interior surface of said right releasably connectable L-shaped half; and b. a multi-tap transformer mountable to said first and second interior fastener channels.

5. The speaker system of claim 1, comprising:

a. left and right exterior front spring cavity alignable halves in respective said left and right releasably connectable L-shaped halves;

b. left and right alignable front coil spring half-axles extending inwardly from respective left and right cavity sidewalls of respective said left and right exterior front spring cavity alignable halves;

c. left and right transverse concave cavity floor sections in respective said left and right exterior front spring cavity alignable halves partially surrounding respective said left and right alignable front coil spring half-axles;

d. a front coil spring mountable on said left and right alignable front coil spring half-axles during assembly;

e. wherein said left and right alignable front coil spring half-axles are alignable, during assembly of said speaker system, to form a single axle for mounting said coil spring; and f. a front wire foot extending from said front coil spring.

6. The speaker system of claim 1, comprising:

a. left and right exterior bottom rear spring cavity alignable halves in respective said left and right releasably connectable L-shaped halves;

b. left and right alignable bottom rear coil spring half-axles within respective said left and right exterior bottom rear spring cavity alignable halves;

c. left and right concave cavity floor sections in respective said left and right exterior bottom rear spring cavity alignable halves partially surrounding respective said left and right alignable bottom rear coil spring half-axles;

d. a bottom rear coil spring mountable on said left and right alignable bottom rear coil spring half-axles during assembly;

e. wherein said left and right alignable bottom rear coil spring half-axles are alignable, during assembly of said speaker system, to form a single axle for mounting said bottom rear coil spring; and f. a bottom rear wire foot extending from said bottom rear coil spring.

7. The speaker system of claim 1, comprising left and right circumferential grooves in respective left and right interior surfaces of respective said left and right semi-cylindrical sides of said acoustic channel cylindrical shell, configured to receive and secure a basket rim of said downwardly-directed speaker assembly, when said speaker system is assembled.

8. The speaker system of claim 1, comprising an ANALOG OUT jack, an ANALOG IN jack, a TAP SETTING slider switch, a ZONE SELECT slider switch, and an array of configuration switches with LED indicator lights manually accessible on said electronics connection panel, when said speaker system is assembled.

9. The speaker system of claim 1, comprising an electronics chassis extending from an interior surface of said electronics connection panel.

10. The speaker system of claim 9, comprising an electronics package mountable to said electronics chassis.

11. The speaker system of claim 1, comprising one of:

a. a sound diffuser slidingly and threadingly engageable to said acoustic channel shell, when assembled; and b. a sound director slidingly and threadingly engageable to said acoustic channel shell, when assembled.

12. An L-shaped strategically hidden speaker system comprising:

a. a tubular L-shaped housing comprising:

i. right and left releasably connectable L-shaped halves;

ii. right and left sides of an acoustic channel cylindrical shell, each extending downwardly from respective right and left front ends of respective said right and left releasably connectable L-shaped halves; and iii. right and left circumferentially spaced apart and opposed sets of partial threads on right and left exterior surfaces of respective said right and left sides of said acoustic channel cylindrical shell; and b. a downwardly-directed speaker assembly in said front end of said housing, when said speaker system is assembled;

c. an electronic connection panel closing an inclined rear end of said housing, when said speaker system is assembled;

d. left and right central circumferential grooves in respective left and right interior surfaces of respective said left and right sides of said acoustic channel cylindrical shell, configured to receive and secure a basket rim of said downwardly-directed speaker assembly, when said speaker system is assembled.

13. The speaker system of claim 12, comprising an ANALOG OUT jack, an ANALOG IN jack, a TAP SETTING slider switch, a ZONE SELECT slider switch, and an array of configuration switches with LED indicator lights manually accessible on said electronics connection panel, when said speaker system is assembled.

14. The speaker system of claim 12, comprising:

a. an electronics chassis extending from an interior surface of said electronics connection panel;

b. an electronics package mountable to said electronics chassis.

15. The speaker system of claim 12, comprising:

a. left and right exterior front spring cavity alignable half portions in respective said left and right releasably connectable L-shaped halves;

b. left and right alignable front coil spring half-axles extending inwardly from respective left and right cavity sidewalls of respective said left and right exterior front spring cavity alignable halves;

c. left and right transverse concave cavity floor sections in respective said left and right exterior front spring cavity alignable halves partially surrounding respective said left and right alignable front coil spring half-axles;

d. a front coil spring mountable on said left and right alignable front coil spring half axles during assembly;

e. said left and right alignable front coil spring half-axles are alignable, during assembly of said speaker system, to form a single axle for mounting said coil spring; and f. a front wire foot extending from said front coil spring.

16. The speaker system of claim 12, comprising:

a. left and right exterior bottom rear spring cavity alignable halves in respective said left and right releasably connectable L-shaped halves;

b. left and right alignable bottom rear coil spring half-axles within respective said left and right exterior bottom rear spring cavity alignable halves;

c. left and right concave cavity floor sections in respective said left and right exterior bottom rear spring cavity alignable halves partially surrounding respective said left and right alignable bottom rear coil spring half-axles;

d. a bottom rear coil spring mountable on said left and right alignable bottom rear coil spring half-axles during assembly;

e. wherein said left and right alignable bottom rear coil spring half-axles are alignable, during assembly of said speaker system, to form a single axle for mounting said bottom rear coil spring; and f. a bottom rear wire foot extending from said bottom rear coil spring.

17. The speaker system of claim 12, comprising:

a. a plurality of exterior fastener channel openings in said right releasably connectable L-shaped half;

b. a first corresponding plurality of interior fastener channel extensions extending inwardly from respective said first plurality of exterior fastener channel openings in said right releasably connectable L-shaped half;

c. a second corresponding plurality of interior fastener channels extending from an interior surface of said left releasably connectable L-shaped half, wherein said second corresponding plurality of interior fastener channels are alignable to respective said first corresponding plurality of interior fastener channel extensions; and d. first and second interior fastener channels extending inwardly from an interior surface of said right releasably connectable L-shaped half; and e. a multi-tap transformer mountable to said first and second interior fastener channels.

18. An L-shaped strategically hidden speaker system comprising:

a. a tubular L-shaped housing comprising:

i. right and left releasably connectable L-shaped halves;

ii. right and left semi-cylindrical sides of an acoustic channel cylindrical shell, each extending downwardly from respective right and left front ends of respective said right and left releasably connectable L-shaped halves; and iii. first and second circumferentially spaced-apart and opposed sets of partial threads on respective first and second exterior surfaces of respective said right and left semi-cylindrical sides of said acoustic channel cylindrical shell; and b. a downwardly-directed speaker assembly in said front end of said housing, when said speaker system is assembled;

c. an electronic connection panel closing an inclined rear end of said housing, when said speaker system is assembled;

d. left and right circumferential grooves in respective left and right interior surfaces of respective said left and right semi-cylindrical sides of said acoustic channel cylindrical shell, configured to receive and secure a basket rim of said downwardly-directed speaker assembly, when said speaker system is assembled;

e. an ANALOG OUT jack, an ANALOG IN jack, a TAP SETTING slider switch, a ZONE SELECT slider switch, and an array of configuration switches with LED indicator lights manually accessible on said electronics connection panel, when said speaker system is assembled;

f. an electronics chassis extending from an interior surface of said electronics connection panel;

g. an electronics package mountable to said electronics chassis.

19. The speaker system of claim 18, comprising:

a. a first plurality of exterior fastener channel openings in said right releasably connectable L-shaped half;

b. said first corresponding plurality of interior fastener channel extensions extending inwardly from respective said first plurality of exterior fastener channel openings in said right releasably connectable L-shaped half;

c. a second corresponding plurality of interior fastener channels extending from an interior surface of said left releasably connectable L-shaped half, wherein said second corresponding plurality of interior fastener channels are alignable to respective said first corresponding plurality of interior fastener channel extensions;

d. first and second interior fastener channels extending inwardly from an interior surface of said right releasably connectable L-shaped half; and e. a multi-tap transformer mountable to said first and second interior fastener channels.

20. The speaker system of claim 18, comprising:

a. left and right exterior front spring cavity alignable halves in respective said left and right releasably connectable L-shaped halves;

b. left and right alignable front coil spring half-axles extending inwardly from respective left and right cavity sidewalls of respective said left and right exterior front spring cavity alignable halves;

c. left and right transverse concave cavity floor sections in respective said left and right exterior front spring cavity alignable halves partially surrounding respective said left and right alignable front coil spring half-axles;

d. a front coil spring mountable on said left and right alignable front coil spring half-axles during assembly;

e. wherein said left and right alignable front coil spring half-axles are alignable, during assembly of said speaker system, to form a single axle for mounting said coil spring;

f. a front wire foot extending from said front coil spring;

g. left and right exterior bottom rear spring cavity alignable halves in respective said left and right releasably connectable L-shaped halves;

h. left and right alignable bottom rear coil spring half-axles within respective said left and right exterior bottom rear spring cavity alignable halves;

i. left and right concave cavity floor sections in respective said left and right exterior bottom rear spring cavity alignable halves partially surrounding respective said left and right alignable bottom rear coil spring half-axles;

j. a bottom rear coil spring mountable on said left and right alignable bottom rear coil spring half-axles during assembly;

k. wherein said left and right alignable bottom rear coil spring half-axles are alignable, during assembly of said speaker system, to form a single axle for mounting said bottom rear coil spring; and l. a bottom rear wire foot extending from said bottom rear coil spring.

* * * * *